US005762311A

United States Patent [19]

Triglia

[11] Patent Number: 5,762,311

[45] Date of Patent: Jun. 9, 1998

[54] CHRISTMAS TREE STAND LIGHT STRING STORAGE SYSTEM

[75] Inventor: Benito Triglia, Peekskill, N.Y.

[73] Assignee: Innovative Product Deveopment, Yorktown Heights, N.Y.

[21] Appl. No.: 367,107

[22] Filed: Dec. 30, 1994

[51] Int. Cl.[6] ..... F16M 13/00

[52] U.S. Cl. ..... 248/523; 248/519; 362/123

[58] Field of Search ..... 248/519, 521–527; 47/40.5; 362/123, 249, 152

[56] References Cited

U.S. PATENT DOCUMENTS

| | | | |
|---|---|---|---|
| 2,242,597 | 5/1941 | Quandee | 362/123 X |
| 2,260,932 | 10/1941 | Chulick et al. | 248/524 |
| 2,317,049 | 4/1943 | Ginka | 248/527 X |
| 2,416,802 | 3/1947 | Roung | 47/40.5 |
| 2,477,981 | 8/1949 | Havery | 248/527 X |
| 3,017,150 | 1/1962 | Kahle | 248/522 |
| 3,109,596 | 11/1963 | Chernansky | 248/524 X |
| 3,544,783 | 12/1970 | Williams, Sr. | 362/123 |
| 3,872,906 | 3/1975 | Bolanz | 248/523 X |

*Primary Examiner*—Karen J. Chotkowski
*Attorney, Agent, or Firm*—Nolte, Nolte and Hunter, P.C.

[57] ABSTRACT

A Christmas tree stand stores by rotation a decorative electrical light string in an orderly manner on an enclosed rotary drum, and also delivers and electrically energizes the light string for decorating the tree.

3 Claims, 4 Drawing Sheets

24
28
30
29
66
66
20
60
38
82
34
80
54
36
98

CHRISTMAS TREE STAND LIGHT STRING STORAGE SYSTEM

BACKGROUND OF THE INVENTION

1. Field of the Invention

This invention is concerned with safe and convenient storage, retrieval and installation of Christmas tree lights on a tree from season to season. More particularly it relates to a Christmas tree stand which stores, and sequentially dispenses, activates, and retrieves a string of Christmas tree lights.

2. Description of the Prior Art

A person trying to decorate a Christmas tree with a string of lights that was stored away the year before often has to untangle wire and light bulbs which seem to have magically woven themselves together even after having been folded or wrapped away with the best of care last season. When the string has miniature lamps, more than one lamp is found broken.

After the string is laid out straight, repaired and tested, it is installed on the tree, and one end is extended to and plugged into a wall socket. Two or more installed strings are extended to a number of wall sockets or to a single extension cord and to a wall socket. Unless special care is taken to fasten the extended electrical cord or cords to the floor or to the Christmas tree stand, a hazard exists, especially when excited children are moving about the tree. One can catch the cord and thereby pull the energized lights from the tree or pull the tree down on the person.

The art abounds with inventions directed toward lessening the above difficulties.

P. J. Werner et al., in U.S. Pat. No. 1,761,062 patented Jun. 3, 1930, discloses a Christmas tree holder or stand in the shape of a miniature house with a yard. The tree is held by the chimney of the house, and fastened in place by thumb screws tapped through the four vertical walls of the chimney.

A first electrical cord extends from within the house for plugging into a wall outlet. The cord supplies electrical power to sockets on the outside of the back wall of the house. Sufficient space is provided in the chimney for bringing a second electrical cord from tree ornamentation down into the house by way of the chimney adjacent to the tree trunk, and out an opening in the back of the house for direct access there to the sockets on the back wall.

The first electrical cord also provides power for a lamp within the miniature house which illuminates the walls which have transparencies in the form of windows.

U.S. Pat. No. 3,109,596, patented Nov. 5, 1963 by J. Chernansky discloses a Christmas tree stand having a tubular standard for holding the tree trunk, mounted on a base plate. A plurality of vertically oriented electric light sockets are mounted permanently on the base plate in a circle around the standard. An electrical cord connected to the sockets extends from the base plate for plugging into a wall outlet.

McAllister et al., in U.S. Pat. No. 5,064,067, patented Nov. 12, 1991 discloses a frame for storing a string of Christmas lights. The generally rectangular, planar frame has outward projecting pins or teeth on two opposite outer edges of the frame. The string of lights is wrapped around the frame with the wire of the string guided between the pins. This provides parallel wrap of the wire across the front and back of the frame, which keeps the bulbs from tangling with each other.

J. Miller, in U.S. Pat. No. 5,287,965, patented Feb. 22, 1994, discloses a portable rectangular form which is assembled from several flat corrugated sheets which are provided perforated, scored or otherwise prepared for folding when the form is needed for storing a string of Christmas tree lights.

The lights are installed on the tree by walking around the tree, wrapping the string around the tree as the installer takes it from the form by rotating the form. A sheath, supported by end walls on the form, is wrapped around the form over the string, to protect the light bulbs from damage in storage.

SUMMARY OF THE INVENTION

It is one object of the invention to provide a Christmas tree stand which stores a string of Christmas tree lights.

It is another object of the invention that the string of lights can be stored in the stand without self entanglement.

It is another object that the string of lights can be removed from storage in a straight strand, ready for installing on the tree.

It is another object that the string of lights can be powered by the stand.

It is another object that the stand may be connected by a single electric line to a wall socket, for powering the strand by the stand.

It is another object that storage and retrieval can be accomplished with minimum chance of breaking a lamp.

It is another object that several strings of lights can be stored and retrieved from the stand as above, so that the tree can be decorated quickly, safely, and vertically without having to wrap the string around the tree.

Other objects and advantages will become readily apparent to a reader from the ensuing description.

A Christmas tree stand includes means for holding the shaft of the tree in a predetermined position with respect to the base of the stand.

Storage drum means for storing electrical decorative string means by wrapping of the string means about the storage drum means is supported on the base for rotation about an axis.

Means for connecting the electrical decorative string means to a remote source of electricity is connected to the electrical decorative string means and to the storage drum means.

Electrical conduction means which is rotatable with the drum means comprises the means for connecting the electrical decorative string means to the remote source of electricity.

The outer surface of the storage drum means includes guide means for wrapping the string means in a predetermined pattern on the storage drum means.

Switch means, responsive to the state of storage of the electrical decorative string means on the storage drum means prevents transmission of electrical energy to the string means when the state of storage exceeds a predetermined amount.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

It is to be understood that the phraseology or terminology used herein is for the purpose of description and not of limitation, and that the invention is not limited in its application to only the detail of construction and arrangement of parts illustrated, since the invention is capable of other embodiments and of being practiced or carried out in other ways.

Figure 1:
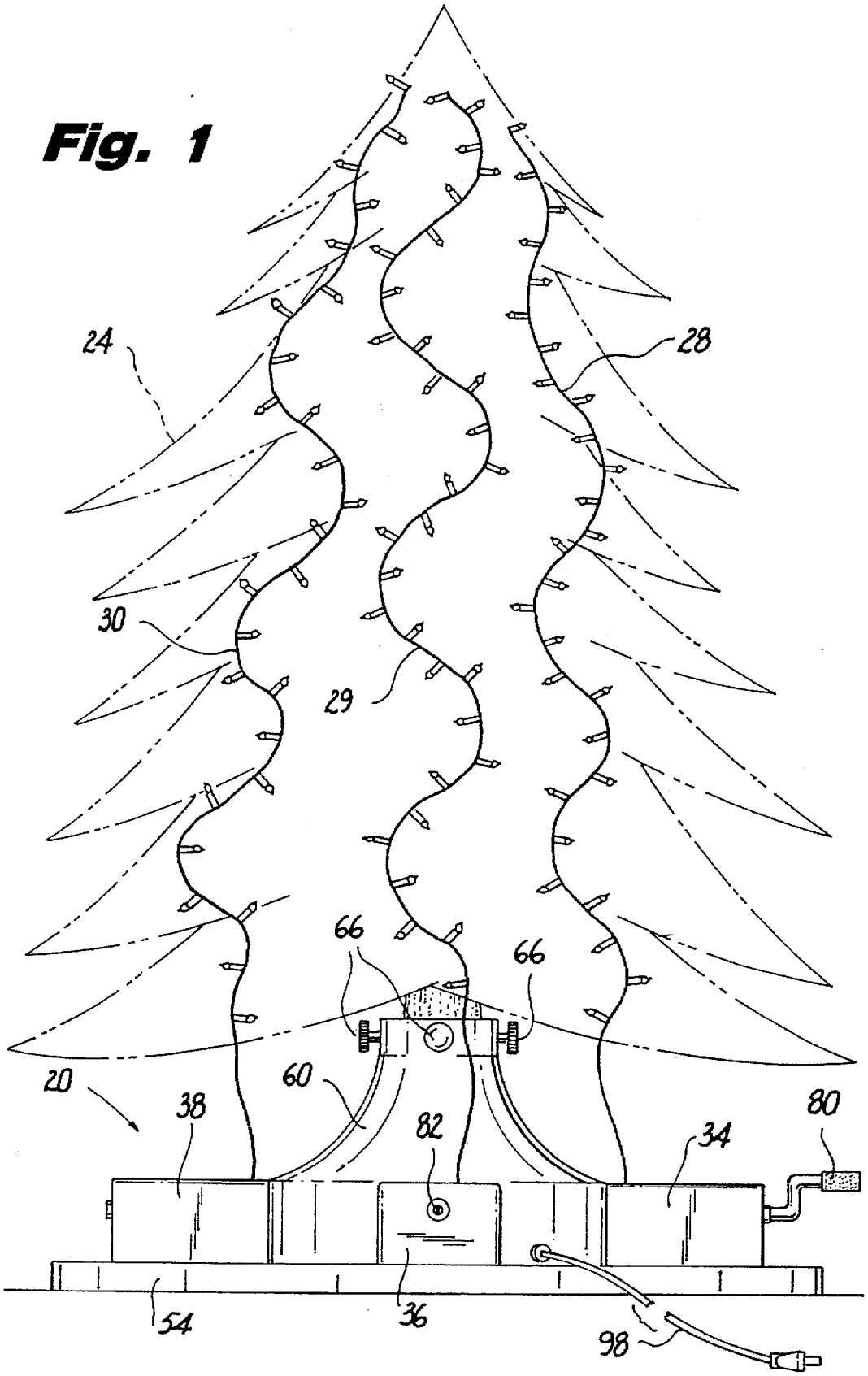
FIG. 1 is a front view of a Christmas tree stand light string storage system according to the present invention, loaded with a tree and several light strings installed on the tree.

In FIG. 1, Christmas tree stand light string storage system 20 is loaded with Christmas tree 24 and several strings of lights 28, 29, and 30.

Each of the strings 28, 29, and 30 is drawn from one of the dispenser modules 34, 36, or 38 respectively.

Each string is dressed vertically, in a zigzag manner on tree 24, rather than helically around the tree so that the strings do not become entangled with one another when they are being removed from the tree for storage.

Figure 2:
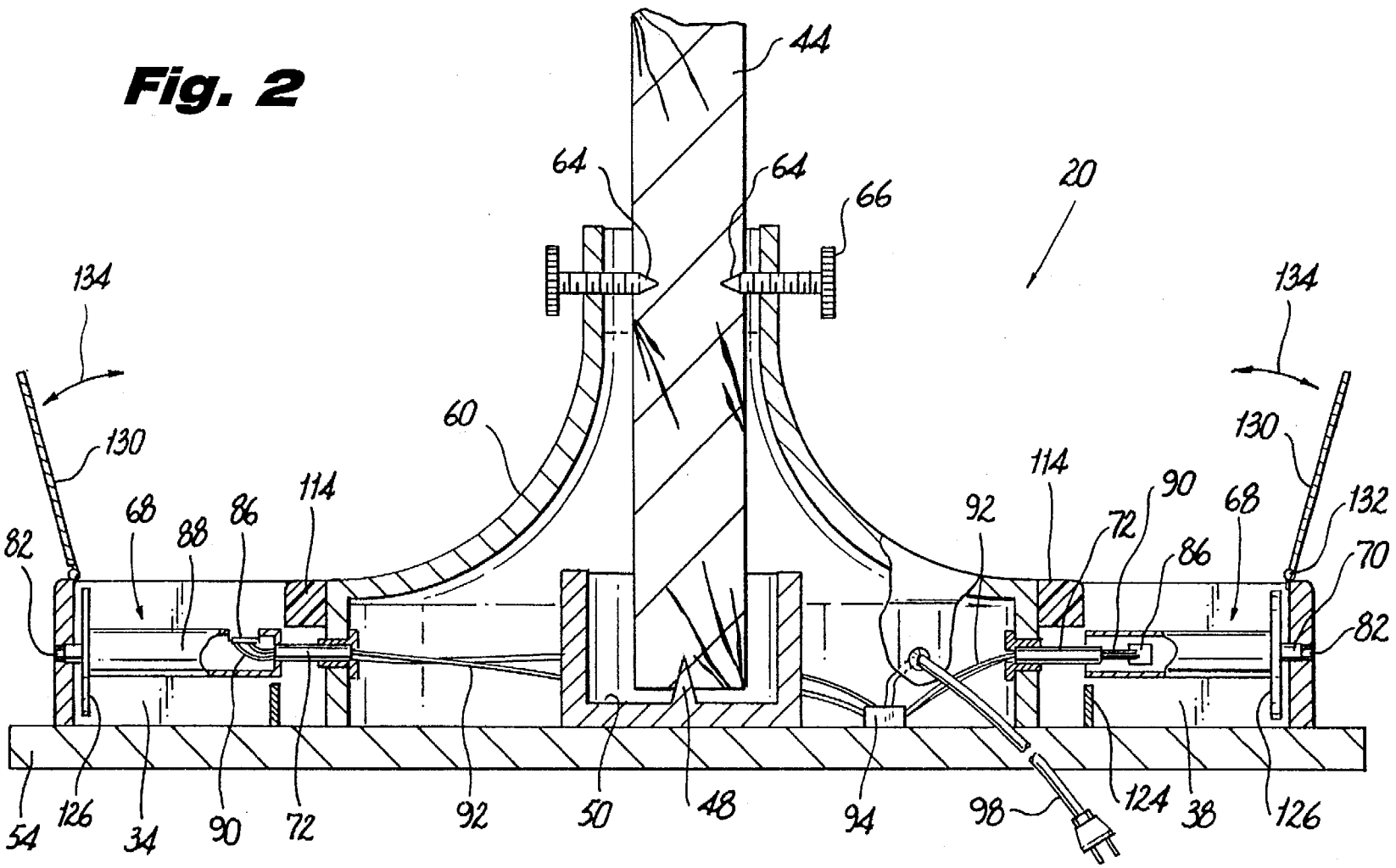
FIG. 2 is a top view of the system of FIG. 1.
Figure 3:
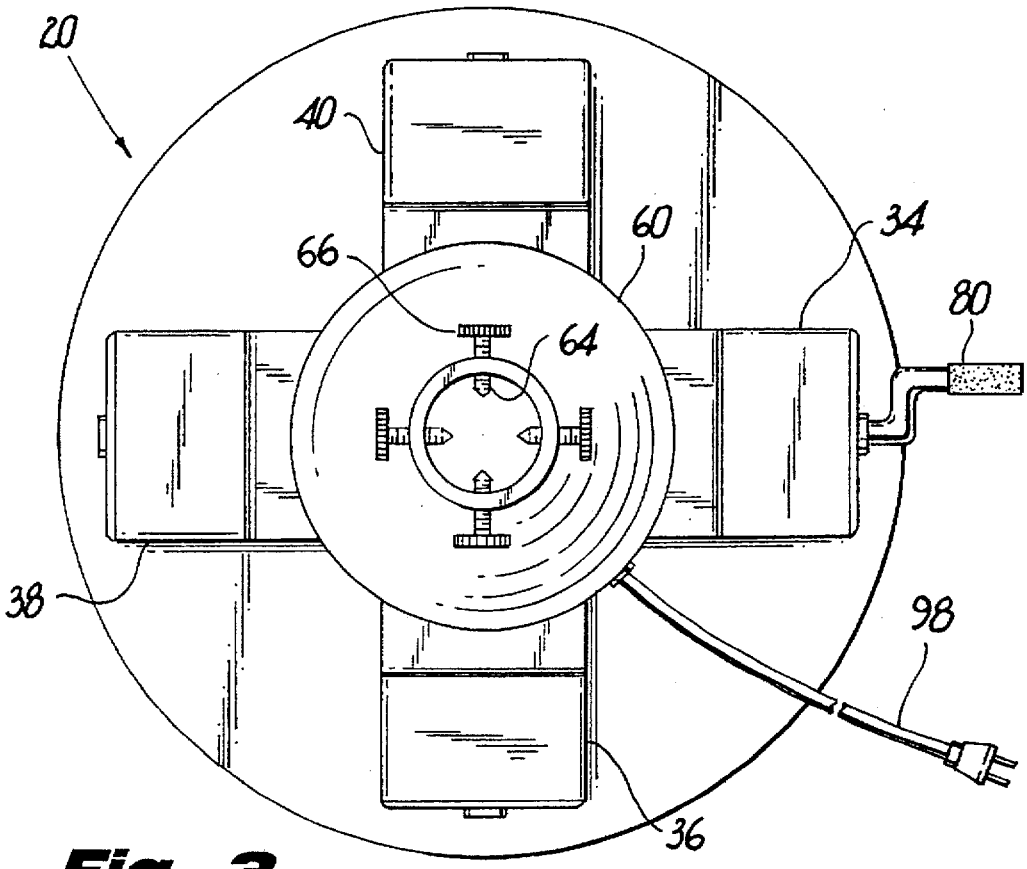
FIG. 3 is a section view of the system of FIG. 1 taken along lines bisecting the stand, without the light strings. Covers of the dispenser modules are rotated to the open position.

Referring to FIGS. 1, 2, and 3, tree trunk 44 rests on spike 48 of water reservoir 50 which is mounted on base 54. The tree is fastened into support cone 60 by sharpened tips 64 of hand screws 66 which are threaded into the cone.

Mechanisms within each of the dispenser modules 34, 36, 38, and 40, are similar. Light string storage drum 68 is rotatably supported by drive shaft 70 and electrical transmission slip shaft 72 within dispenser module 34. Shafts 70 and 72 define an axis of rotation for the drum. Drum 68 is turned by hand crank 80 which engages shaft 70 by way of keyway 82.

Electrical socket 86 which is recessed within the outer surface 88 of drum 68 is designed to receive plugs from light strings which are commonly available on the market. Socket 86 obtains electrical energy from pick up wire 90 which is electrically connected to distribution wire 92 by way of electrical transmission slip shaft 72. Slip shaft 72 provides rotatable bearing support for the drum and includes means for transmitting electrical energy between rotating and stationary electrical wires. Electromechanical bearing assemblies for delivering electrical energy through a rotating bearing as required for slip shaft 72 are commercially available.

Distribution wires 92 plug into distribution socket 94. Electrical appliance wire 98 for plugging into a remote electricity source such as a standard wall socket, provides electrical energy to socket 94.

Figure 4:
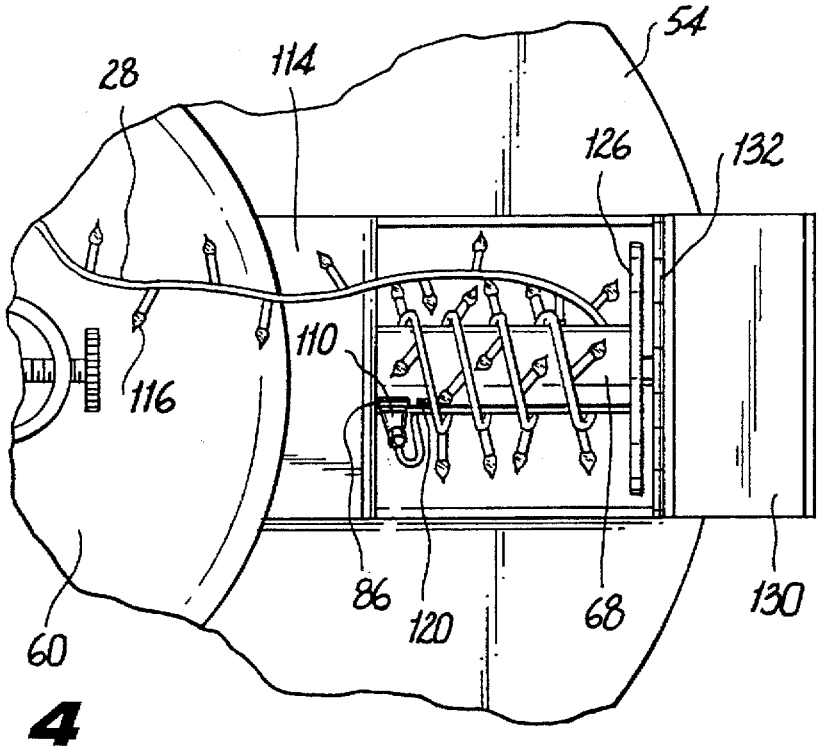
FIG. 4 is a top, partial view, of a stand according to the invention. The cover of the dispenser module is rotated open, and a light string is partially withdrawn from the dispenser module.
Figure 5:
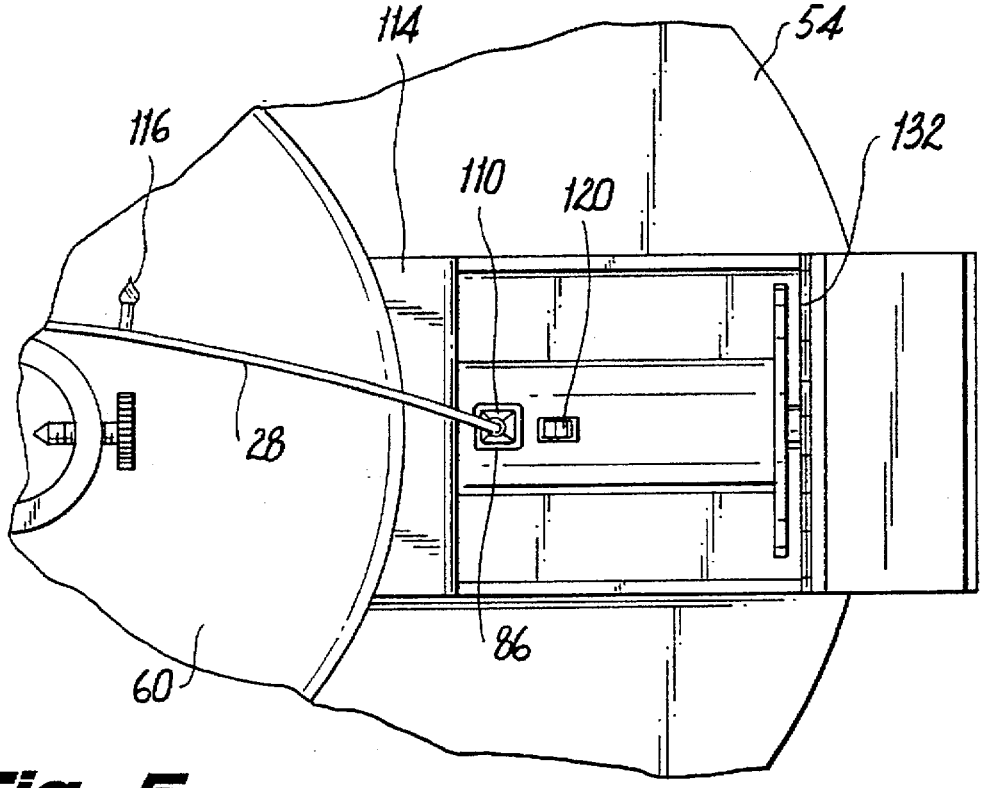
FIG. 5 is a top partial view of a stand in which the light string is fully withdrawn from the dispenser module.
Figure 6:
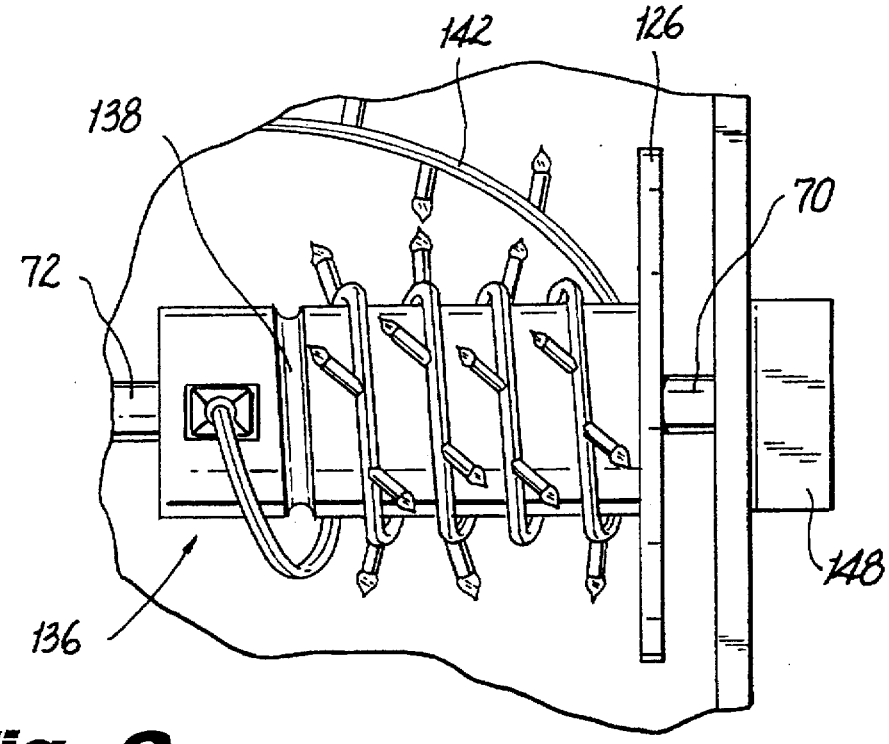
FIG. 6 is a top view of a dispenser module drum in another embodiment of the present invention.

Referring additionally to FIGS. 4 and 5, light string 28 plugs into socket 86 by way of plug 110. In FIG. 4 it is wrapped helically about drum 68 by rotating the drum clockwise as seen from keyway 82. In FIG. 5, it is unwrapped by rotating the drum counterclockwise while carefully drawing the light string away for attaching it to the tree.

As a safety measure, plastic lip 114 keeps the string from sliding off the drum at the top of the drum, and provides a smooth slideway for the brittle lamps as they pass over the lip and up along support cone 60.

Margin strip 124 keeps the string from sliding off the drum at the bottom of the drum. End wall 126 keeps the string from sliding off the opposite end of the drum.

The inner walls of the dispenser module can also be curved to prevent the light string from slipping off the drum.

It is common sense not to plug a system into a wall while a light string is wrapped on the drum. Normally one would pull all plugs within the system when storing the light strings, and plug them in after the strings are installed on the tree.

In one embodiment, for another safety measure, micro switch 120 prevents socket 86 from providing electrical energy when the switch is depressed by a light string wrapped around the drum greater than a predetermined amount. If system 20 is plugged in a wall socket, and all wires within the system are connected, the socket provides electrical energy to the light string when the light string is removed sufficiently from the drum to release the micro switch.

Cover 130 is attached to, and rotates on hinge 132 as shown by arrows 134. The cover closes over the module with sufficient room to clear a maximum design light strip load on the drum enclosed within the housing formed by the side and bottom walls, of the dispenser module.

Storage drum 136 includes spiral guide trough 138 made by a radially oriented, spiral wall. Trough 138 avoids tangling of light string 142 when it is being stored, by guiding the light string into the trough and isolating each turn of the light string from the others. Drive motor 148 drives shaft 70 at a slow rate of revolution clockwise or counterclockwise for loading or unloading string 142 on drum 136.

The drum is preferably mounted on the shafts for rotation about a central axis, but may be mounted for eccentric rotation about the axis.

Although the invention has been described in terms of specific preferred embodiments, it will be obvious to one skilled in the art that various modifications and substitutions are contemplated by the invention disclosed herein and that all such modifications and substitutions are included within the scope of the invention as defined in the appended claims.

For example, the storage drum may be any shape and made from any material which will take on a light string or other electrical decorative string when the drum is rotated. It may be octagonal, square, or rectangular in cross section. It may be hollow, solid, or an assembly of parallel rods, and made of metal or plastic as practical construction and economy may dictate.

What is claimed is:

1. A stand for an ornamental tree with a shaft, in combination with at least one means for receiving an electrical decorative string comprising: a base, means mounted on said base for temporarily holding the shaft in a predetermined position with respect to said base, said means for receiving the electrical decorative string comprising storage drum means for storing the electrical decorative string wound therearound, means mounting said storage drum means for rotation about an axis, said storage drum means further comprising means when rotating in one direction for winding the electrical decorative string about said storage drum means and when rotating in another direction for paying out the electrical decorative string, and means associated with said receiving means for connecting the electrical decorative string means to a remote source of electricity.

2. The stand of claim 1, further comprising:

said means for connecting said electrical decorative string means to a remote source of electricity being attached to said storage drum means.

3. The stand of claim 2, further comprising:

electrical conduction means rotatable with said storage drum means and comprising said means for connecting said electrical decorative string means to a remote source of electricity.

* * * * *